US007806538B2

(12) United States Patent
Ajiki et al.

(10) Patent No.: US 7,806,538 B2
(45) Date of Patent: Oct. 5, 2010

(54) LIGHT SOURCE DEVICE AND VEHICLE LIGHTING DEVICE

(75) Inventors: Shuichi Ajiki, Tokyo (JP); Koichi Masuyama, Tokyo (JP); Naoya Sone, Tokyo (JP); Sadayuki Konishi, Tokyo (JP); Yasuo Toko, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 190 days.

(21) Appl. No.: 12/127,176

(22) Filed: May 27, 2008

(65) Prior Publication Data

US 2008/0291689 A1 Nov. 27, 2008

(30) Foreign Application Priority Data

May 25, 2007 (JP) ..... 2007-139481

(51) Int. Cl.
*F21V 33/00* (2006.01)

(52) U.S. Cl. ..... 362/19; 362/627; 362/618; 362/511; 362/538

(58) Field of Classification Search ..... 362/19
See application file for complete search history.

(56) References Cited

U.S. PATENT DOCUMENTS

| | | | | |
|---|---|---|---|---|
| 7,321,464 | B2 * | 1/2008 | Ouderkirk et al. | 359/495 |
| 2004/0017675 | A1 * | 1/2004 | Yang | 362/19 |
| 2004/0109303 | A1 * | 6/2004 | Olczak | 362/19 |
| 2006/0007700 | A1 * | 1/2006 | Hsu et al. | 362/600 |
| 2006/0022211 | A1 | 2/2006 | Yatsuda et al. | |
| 2007/0002586 | A1 * | 1/2007 | Soh et al. | 362/607 |
| 2007/0047214 | A1 * | 3/2007 | Nesterenko et al. | 362/19 |

FOREIGN PATENT DOCUMENTS

| | | |
|---|---|---|
| JP | 2001076510 | 3/2001 |
| JP | 2003503815 | 1/2003 |
| JP | 2004233936 | 8/2004 |
| JP | 2006048934 | 2/2006 |
| WO | WO01/01037 | 1/2001 |

* cited by examiner

*Primary Examiner*—Laura Tso
(74) *Attorney, Agent, or Firm*—Kenealy Vaidya LLP

(57) ABSTRACT

An LED light source device can have a simple configuration which can easily create a desired light distribution pattern with a low profile and light weight. An illumination apparatus and a vehicle lighting device can also be configured to use the LED light source device. The light source device can include a light guide plate made of a flat plate-like material that is transparent in the visible range, and which has a front surface serving as a light emission surface. A point light source can be opposed to an end surface of the light guide plate. A rear surface of the light guide plate can include a luminance control element configured to control a luminance distribution on the light emission surface. The luminance control element controls light from the light source, incident through the end surface of the light guide plate, so that a reduced inversion of a light distribution pattern that is to be emitted is formed on the light emission surface as the luminance distribution. The light guide plate can include a polarizing film for making the light emission surface emit p-polarized (parallel polarized) light.

27 Claims, 14 Drawing Sheets

LIGHT SOURCE DEVICE AND VEHICLE LIGHTING DEVICE

This application claims the priority benefit under 35 U.S.C. §119 of Japanese Patent Application No. 2007-139481 filed on May 25, 2007 which is hereby incorporated in its entirety by reference.

BACKGROUND

1. Technical Field

The presently disclosed subject matter relates to a light source device which uses a plurality of LED devices or the like as its light source. The presently disclosed subject matter also relates to a vehicle lighting device which uses this light source device, such as a headlight, an auxiliary headlight, tail-light, fog light, signal light, or the like.

2. Related Art

A conventional light source device utilizing an LED device has been known for use in a vehicle headlight, an LED lamp for use as a light source, and the like.

An example of a conventional vehicle headlight is disclosed in the Japanese Translation of PCT application No. 2003-503815 (corresponding to PCT Publication No. WO 01/001037) as shown in FIG. 1. The vehicle headlight of this type includes a light source which is composed of a plurality of light emitting diodes 1 arranged side by side, and an optical member (not shown) such as a lens located in front of the light source.

According to this configuration, the light emitted from the respective light emitting diodes 1 is given a distribution characteristic through the lens or other optical members arranged in front thereof, and is emitted outside. As a result, a desired light distribution property for the vehicle headlight is provided.

FIG. 2A shows a lighting device having an LED lamp as disclosed in Japanese Patent Application Laid-Open No. 2006-048934 (corresponding to U.S. Patent Publication No. 2006/022211A1). The lighting device includes an LED lamp 2 (see FIG. 2B) and a concave reflector 3. The LED lamp 2 is composed of a plurality of LEDs 2*b* which are arranged in a row on a substrate 2*a* so as to have an emission pattern similar to that of a filament type light emitting source. The reflector 3 is situated so that its focus lies near the light emitting point of the LED lamp 2.

According to this configuration, the light emitted from the LED lamp 2 is reflected by the reflector 3 and projected toward the front in the direction of light illumination. Consequently, the light emitting portion of the LED lamp 2 is projected forward with desired light distribution characteristics.

FIG. 3 shows another type of headlight disclosed in Japanese Patent Application Laid-Open No. 2001-076510. In contrast to the headlight and the lighting device described above utilizing LED devices, this headlight is configured to be a typical projector type headlight 4, which is composed of a bulb 5 as a light source, a reflector 6, a projection lens 7, and a light-shielding member 8.

The reflector 6 is composed of an elliptical reflecting surface whose first focus (rear focus) falls on or near the bulb 5 and whose major axis extends generally horizontally toward the front in the direction of light illumination. The inner side thereof constitutes the reflector.

The projection lens 7 is composed of a convex lens, or preferably an aspherical lens, and is arranged so that its focus on the light-source side (rear side) lies in the vicinity of the second focus of the reflector 6.

The light-shielding member 8 is intended to give the light projected forward a light distribution pattern for a predetermined low beam, and is arranged near the second focus of the reflector 6. The top edge 8*a* of the light-shielding member 8 is formed in a predetermined shape so as to create a cut-off line in the light distribution pattern.

Light emitted from the bulb 5 of the headlight 4 configured as described above is directly incident on the projection lens 7 and is then projected in the front illumination direction. Alternatively, the light is reflected by the reflector 6 to be focused near the second focus of the reflector 6 and the virtual image formed near the focus is reversed by the projection lens 7 to be projected in the front illumination direction.

On this occasion, part of the virtual image is shielded by the light-shielding member 8, so that the top edge 8*a* of the light-shielding member 8 forms a cut-off line C (see FIG. 4). The shaped virtual image is thus projected forward as a low beam.

It should be noted that when the virtual image shown in FIG. 4 is projected through the projection lens 7, the resulting light distribution pattern is vertically and horizontally reverse to the virtual image of FIG. 4, i.e., forms a light distribution pattern for right-side traffic. That is, the light distribution pattern has a luminance distribution such that the cut-off line C suppresses illumination from the center to the left in order to prevent any glare of light towards an opposite traveling vehicle.

As described above, vehicle lighting devices usually emit light with a light distribution pattern intended for a low beam (passing-by pattern), a high beam (traveling pattern), or the like. The light distribution pattern having a cut-off line C in particular will be defined as a cut-off pattern.

Japanese Patent Application Laid-Open No. 2004-233936 also describes a vehicle lamp apparatus. In particular, as shown in FIG. 5 of the Laid Open application, the apparatus includes an optical system for projecting light emitted from a light source toward the front in the direction of light illumination, along with two polarizing beam splitters, two half-wave plates, and other components which are arranged within this optical system. The light emitted from the light source (non-polarized light) is separated into p-polarized components and s-polarized components through the polarizing beam splitters. Assuming the s-polarized components to be a first perpendicular polarized beam, the p-polarized components are converted into a second perpendicular polarized beam through the half-wave plates, and these two perpendicular polarized beams are projected forward in the direction of light illumination.

By doing so, the light from the light source is separated into p- and s-polarized components, converted into respective perpendicular polarized beams, and projected forward in the direction of light illumination. Accordingly, it is possible to reduce reflection of light due to water particles when in heavy fog or in rain, thereby improving the visibility in front of the vehicle.

The vehicle headlight disclosed in Japanese Translation of PCT application No. 2003-503815 (corresponding to PCT publication No. WO 01/001037) includes a plurality of light emitting diodes 1 arranged side by side in order to provide a desired or required light intensity—enough for a lighting device.

A light source consisting of these juxtaposed light emitting diodes alone, however, cannot achieve a desired light distribution pattern.

In order to provide a desired light distribution pattern, it has thus been necessary to arrange an optical member for light distribution control in front of the light source.

Besides, this vehicle headlight is intended to improve the visibility around the vehicle, not to project light forward in the direction of light illumination to ensure the field of view for the driver of the vehicle.

In the lighting device having an LED lamp disclosed in Japanese Patent Application Laid-Open No. 2006-048934, a plurality of LED chips are built into one package in order to provide a light intensity required of the lighting device.

The light emitting area of this LED lamp, consisting of the plurality of LED chips, has the same shape as that of a conventional filament. Then, a reflecting surface for use in a projector type conventional headlight or the like is used to obtain a desired light distribution pattern.

In order to achieve a desired light distribution pattern, it has thus been necessary to arrange the reflector for light distribution control behind the light source, and a light-shielding member in front, if needed.

In this case, it is difficult, however, to achieve a desired light distribution pattern with only a single LED lamp. Consequently, the headlight must have a plurality of LED lamps, or have a so-called multi-lamp configuration, so that the size of the entire lighting device of the headlight becomes greater. The weight of the entire lighting device of the headlight also increases since the headlight should have a reflector.

This weight increase may not be preferable, especially for achieving the Adaptive Front-Lighting System (AFS) which has enjoyed recent popularity. This is because a large load is unfavorably applied to the drive mechanism in an AFS device.

In addition, since the LED lamps each contain a plurality of LED chips, the light emitting points of the respective LED chips may be visually observable in some cases. The resulting headlight provides a luminance distribution with small variations, whereby the appearance may deteriorate or not be desirable.

The headlight disclosed in Japanese Patent Application Laid-Open No. 2001-076510 also requires a reflector, and in some cases a light-shielding member inside the lighting device. The entire lighting device of the headlight therefore increases in size and in weight, with a depth as large as 130 mm or so, for example.

In addition, the reflector for use in this headlight has been designed so as to correspond to the shape of the light emitting portion of the light source bulb. It has thus taken a relatively long time to design such a reflector.

Now, under light distribution regulations and the like, typical vehicle lighting devices including those described in the foregoing patent documents are increasingly subject to control with respect to glare of light that is permissible on opposite traveling vehicles.

Specifically, European standards ECE (Reg. No. 98) and FMVSS define measuring points intended for controlling glare of light to opposite traveling vehicles in rainy weather. To be more specific, the measuring points are on the line of 4.29 D in accordance with ECE, and 4 D-4 R in accordance with FMVSS.

In terms of distance on the road, the measuring points are 9.3 m ahead in accordance with ECE, and 10 m ahead in accordance with FMVSS.

When in the rain, the road surface is usually covered with water films. As shown in FIG. 5A, the light L projected from a vehicle lighting device of the vehicle V is reflected forward at the surface of a water film W on the road.

At the position of incidence of the light L on the surface of the water film W, as shown in FIG. 5B, the angle of incidence θ1 and the angle of reflection θ2 are almost the same. Then, the reflected light L1 travels forward in a slightly upward direction.

In the meantime, as shown in FIG. 5B, light L2 that enters the water film W from the position of incidence on the surface of the water film W travels with a predetermined angle of refraction θ3 based on the refractive index of water until it reaches the road surface. This light L2 is then diffused by pits and projections of the road, and returns in part toward the vehicle V and reaches the driver. The driver can thus grasp, determine and understand the road condition.

In reality, however, most of the projected light L is reflected at the surface of the water film W as shown in FIG. 5A, so that the reflected light L1 travels forward in a slightly upward direction and causes glare of light to opposite traveling vehicles, pedestrians, and so on. This characteristics makes it difficult to meet the foregoing regulations on glare of light.

Furthermore, the vehicle lighting device as disclosed in Japanese Patent Application Laid-Open No. 2004-233936 can project perpendicular polarized light forward in the direction of light illumination, so that the scattering by water particles such as fog drips and raindrops in heavy fog or in rain is reduced to improve the visibility ahead.

The provision of perpendicular polarized light, however, requires a plurality of beam splitters each consisting or comprised of low refractive index films and high refractive index films deposited alternately, and a plurality of half-wave plates as well. As a result, the increased parts count and the complicated structure make the entire lighting device greater in size. This also requires complicated operations of aligning the optical axes of the optical components during assembly, thereby increasing the parts cost and the assembly cost.

SUMMARY

In view of the foregoing characteristics, features, and problems associated with the conventional lighting devices, an aspect of the presently disclosed subject matter is to provide an LED light source device of simple configuration which can easily create a desired light distribution pattern even with a low profile and light weight, can reduce glare of light ascribable to reflection at the surface of a water film on the road when in the rain, and/or can facilitate visual identification of the road condition beneath the water film. Another aspect includes providing an illumination apparatus and a vehicle lighting device using this LED light source device.

According to another aspect of the presently disclosed subject matter, a light source device can include: a light guide member having a flat plate-like shape and made of a material transparent in a visible range, the light guide member having a front surface serving as a light emission surface and a rear surface having a luminance control element configured to control a luminance distribution on the light emission surface, the front surface and rear surface separated by at least one end surface; and at least one of a point light source and a linear light source facing the at least one end surface of the light guide member. The luminance control element can be configured to control light reaching the control element from the at least one end surface of the light guide member and to configure the light into the luminance distribution of light on the light emitting surface, the luminance distribution configured to form a light distribution pattern to be projected (and in some cases horizontally and vertically reversing the pattern). The light guide member can be configured to emit, from the light emission surface, only parallel polarized light out of the light from the light source, the parallel polarized light being p-polarized with a plane of vibration parallel to a plane that contains an optical axis thereof in the direction of emission and a normal to a road surface.

In accordance with another aspect of the presently disclosed subject, the light guide member can have a polarizing film formed on at least part of the light emission surface.

In accordance with another aspect of the presently disclosed subject, the polarizing film can be formed to cover at least part of an area configured to form the light distribution pattern on the light emission surface of the light guide member.

In accordance with another aspect of the presently disclosed subject, the light guide member can be provided with a stretched polymer film thereinside or thereon, the stretched polymer film having elliptically-shaped small areas of different refractive index with polarization selective diffusibility.

In accordance with another aspect of the presently disclosed subject, at least either one of side surfaces of the stretched polymer film can have pits and projections configured to emit light in a normal direction, the pits and projections formed at a predetermined pitch.

In accordance with another aspect of the presently disclosed subject, the polarizing film or the stretched polymer film can be arranged retractably in an optical path extending from the light source to exterior through the light guide member.

According to another aspect of the presently disclosed subject matter, a vehicle lighting device can include: the light source device in accordance with any of the foregoing aspects; and a convex projection lens configured to project light emitted from the light source device along an optical axis of the lens and forward in a direction of light illumination. Here, the projection lens has a focus on a side of the lens adjacent light source device and located substantially at the light emission surface of the light guide member of the light source device.

In the above configuration, the light emitted from the light source enters the end surface of the light guide member and is repeatedly reflected within the light guide member to exit from the surface of the light guide member.

In this configuration, the light reaching the rear face of the light guide member is reflected by the luminous control element to thereby be controlled in luminous intensity. Namely, the light exiting from the surface of the light guide member has been adjusted to be provided with a predetermined luminance distribution.

Furthermore, the light emitted from the light guide member can comprise or can consist essentially of p-polarized light, because of the configuration of the light guide plate.

Since the light guide member can form a predetermined luminance distribution on its surface, this luminance distribution is projected outside as a distribution pattern of p-polarized light.

For example, the light having a predetermined luminance distribution formed on the surface of the light guide member is projected in the direction of the optical axis by using, for example, a projection lens. Consequently, p-polarized illumination light with the predetermined light distribution pattern can be provided.

In this case, a luminance distribution which is obtained by reducing a light distribution pattern to be projected (and in some cases horizontally and vertically reversing the pattern) is formed on the surface of the light guide member. Accordingly, the lighting device including the present light source device need not have a reflector which is typically included in the conventional lighting devices. This can eliminate the burden of reflector design, thereby facilitating the designing of the lighting device within a shorter period of time.

Furthermore, in accordance with the presently disclosed subject matter, the desired light distribution pattern can be easily adjusted by the luminance control element provided on the rear surface of the light guide member. Accordingly, a lighting device such as a vehicle headlight can be configured to have a desired luminance distribution with ease. For example, if a luminance distribution that can be continuously varied is desired or required, a lighting device such as a vehicle headlight can be configured to emit light which has a continuously varying luminance distribution.

This eliminates a plurality of lighting devices arranged side by side in order to obtain a desired continuously varying luminance distribution. Accordingly, the lighting device such as a vehicle headlight can be small in size with reduced costs.

Furthermore, the p-polarized or parallel polarized light has a lower reflectivity at the water film surface than that of s-polarized or perpendicular polarized light. In the rain where the road surface is covered with a water film, the p-polarized (parallel polarized) illumination light incident on the water film surface then produces a smaller amount of reflection from and a greater amount of penetration into the water film as compared to conventional non-polarized light. This can reduce reflected light, i.e., glare of light directed to opposite traveling vehicles, pedestrians, and so on, thereby making it easier to meet the regulations regarding glare of light.

The light that penetrates into the water film also impinges on the road surface, and is reflected and diffused by the road surface so that it can be visually observed by the driver of the vehicle. This improves the visibility of the road even in the rain.

The light source device may also be used for outdoor lighting to illuminate the road and the like beneath water films effectively.

If the light guide member has the polarizing film on at least part of the light emission surface, then at least part of the light emitted from the light emission surface of the light guide member passes through the polarizing film. The resulting light is thus emitted outside as p-polarized (parallel polarized) light.

If the polarizing film is formed to cover at least part of the area forming the light distribution pattern on the light emission surface of the light guide member, then an area where the angle of incidence to the water film surface exceeds 70°, such as 4 m or more ahead of the vehicle lighting device, can be selectively illuminated with p-polarized (parallel polarized) light. This can effectively reduce glare of light ascribable to reflection at the water film surface.

If the light guide member is provided with a stretched polymer film thereinside or thereon, the stretched polymer film can have elliptically-shaped small areas of different refractive index with polarization and selective diffusibility. Then, at least part of the light traveling through the light guide member passes through the stretched polymer film. The resulting light is thus emitted outside as p-polarized (parallel polarized) light.

If at least either one of the side surfaces of the stretched polymer film has pits and projections configured to emit light in the normal direction, with the pits and projections formed at predetermined pitches, then the light can be easily guided into the normal direction through the reflection of the light at these pits and projections.

If the film is retractably arranged in an optical path extending from the light source to an area exterior of the lighting device and through the light guide member, the film is retracted from the optical path when in good weather conditions and the like where no water film lies on the road and where glare of light is less likely to occur due to reflection at water film surfaces. This makes it possible to emit non-polarized light without loss from the film.

In another configuration, the light emitted from the respective light sources enters the end surface of the light guide member and is repeatedly reflected within the light guide member to exit from the surface of the light guide member. The light reaching the rear surface of the light guide member is reflected by the luminous control element to thereby be controlled in luminous intensity. Namely, the light exiting from the surface of the light guide member can be adjusted to be provided with a predetermined luminance distribution.

In this instance, the projection lens can project the light with the luminance distribution in the front illumination direction, by enlarging and horizontally and vertically reversing the luminance distribution to form a desired light distribution pattern.

In this case, a luminance distribution corresponding to the desired light distribution pattern is formed on the light emitting surface of the light guide member of the light source device. Accordingly, the lighting device including the light source device need not have a reflector which is typically present in conventional vehicle headlights, and can have a small size with light weight and reduced costs, among other features. This facilitates the configuration of a headlight incorporating the AFS function.

When the light emitting surface of the light guide member has a shape corresponding to the pattern including the cut-off area, there is no need to provide a light-shielding member or the like for forming a pattern including such a cut-off area as in the conventional manner, thereby simplifying the structure of the lighting device and resulting in lower manufacturing costs.

The light emitted from the light emission surface of the light guide plate can include or consist essentially of p-polarized (parallel polarized) light. In the rain where the road surface is covered with a water film, the p-polarized (parallel polarized) illumination light incident on the water film surface then produces a smaller amount of reflection from and a greater amount of penetration into the water film as compared to conventional non-polarized light. This reduces reflected light, i.e., glare of light to opposite traveling vehicles, pedestrians, and so on, thereby facilitating meeting the regulations on glare of light.

The light that penetrates into the water film also illuminates the road surface, and is reflected and diffused by the road surface so that it can be visually observed by the driver of the vehicle. This improves the visibility of the road in the rain.

Thus, a desired light distribution pattern can be formed with a simple configuration, which can reduce glare of light ascribable to reflection at water film surfaces, and can improve visibility beneath the water films even with a low profile and light weight. Furthermore, certain embodiments of the presently disclosed subject matter can provide an LED light source device with thin and light-weight structure as well as an illumination device and a lighting device, such as a vehicle headlight, using the LED light source device.

BRIEF DESCRIPTION OF THE DRAWINGS

These and other characteristics, features, and advantages of the presently disclosed subject matter will become clear from the following description with reference to the accompanying drawings, wherein.

DETAILED DESCRIPTION OF EXEMPLARY EMBODIMENTS

Hereinafter, a description will be given of several exemplary embodiments with reference to FIG. 6 through FIG. 16.

First Exemplary Embodiment

Figure 6:
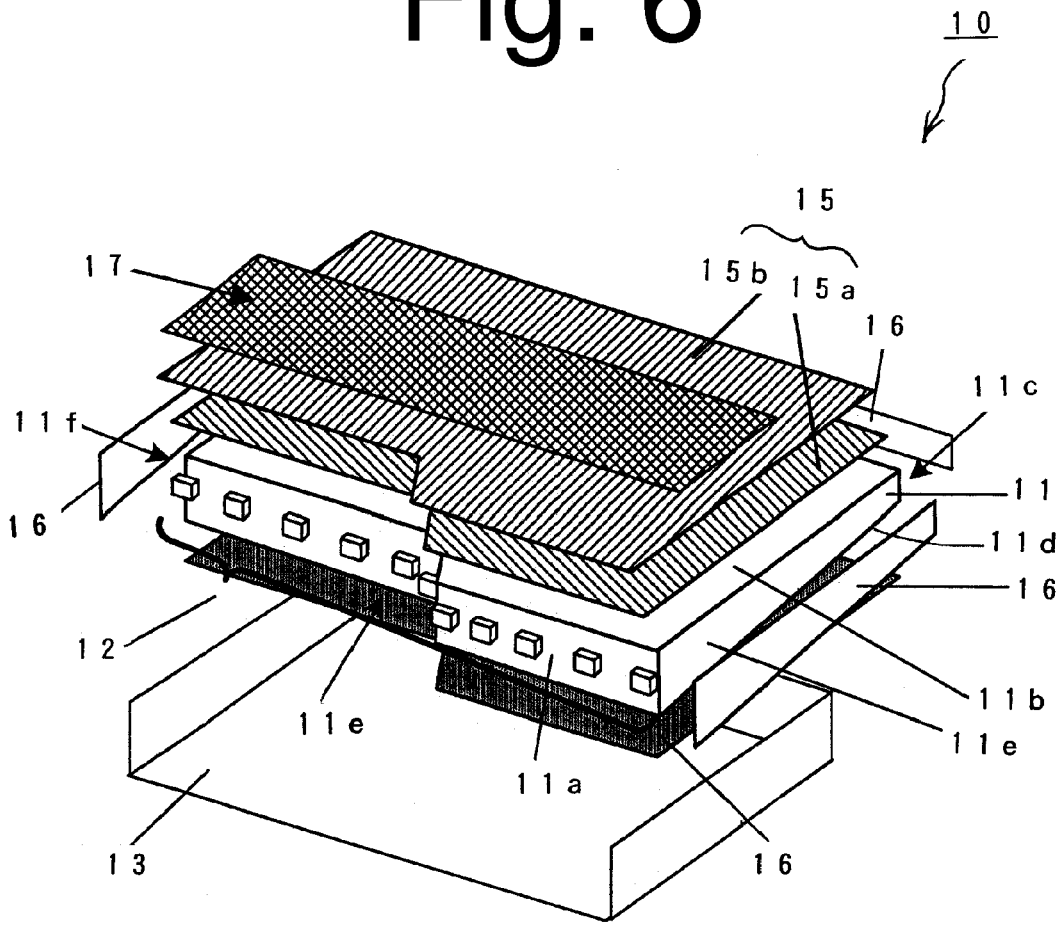
FIG. 6 is a schematic perspective view showing an exemplary embodiment of a light source device for a vehicle headlight made in accordance with principles of the presently disclosed subject matter.

FIG. 6 shows an exemplary embodiment of a light source device for use in a vehicle lighting device. In FIG. 6, the light source device 10 is configured to include a light guide plate (light guide member) 11 and a plurality of LEDs 12 as light sources.

In the shown case, the light guide plate 11 is formed as a flat plate of optically transparent material, i.e., a material that is transparent in the visible range.

Examples of the transparent material of the light guide plate 11 may include, but are not limited to, a transparent resin such as polycarbonate, acrylic resin, and the like, a glass material, and typical optical materials.

The light guide plate 11 has an end surface, which is the nearer side face in FIG. 6, being an incident surface 11*a* and an upper surface which serves as a light emitting surface 11*b*. Furthermore, the light source device 10 may have a housing 13 which is made of a light shielding material and covers the rear surface (bottom surface) 11*d*, right and left side surfaces 11*e* and 11*f*, and another end surface 11*c*.

In the case shown in FIG. 6, the light guide plate 11 may have a constant thickness or may have a wedge shape such that the thickness of the plate 11 at the incident surface 11*a* diminishes towards the other end surface 11*c*. The incident surface 11*a* may be disposed to the cutoff-patterned end surface as shown in FIG. 6, or other end surfaces. Depending on the positions of the light sources, the sectional shape of the light guide member and the arrangement of the luminance control element can be modified as appropriate to achieve a desired light distribution.

The incident surface 11*a* of the light guide plate 11 may be a fine shape composed of prisms or circular arc ridges or alternatively be roughened in order to improve the light incident efficiency.

Furthermore, the light emitting surface 11*b* of the light guide plate 11 may have a shape composed of prisms or lenticular shape, etc., in order to improve the luminous intensity or adjust the light distribution.

Figure 7:
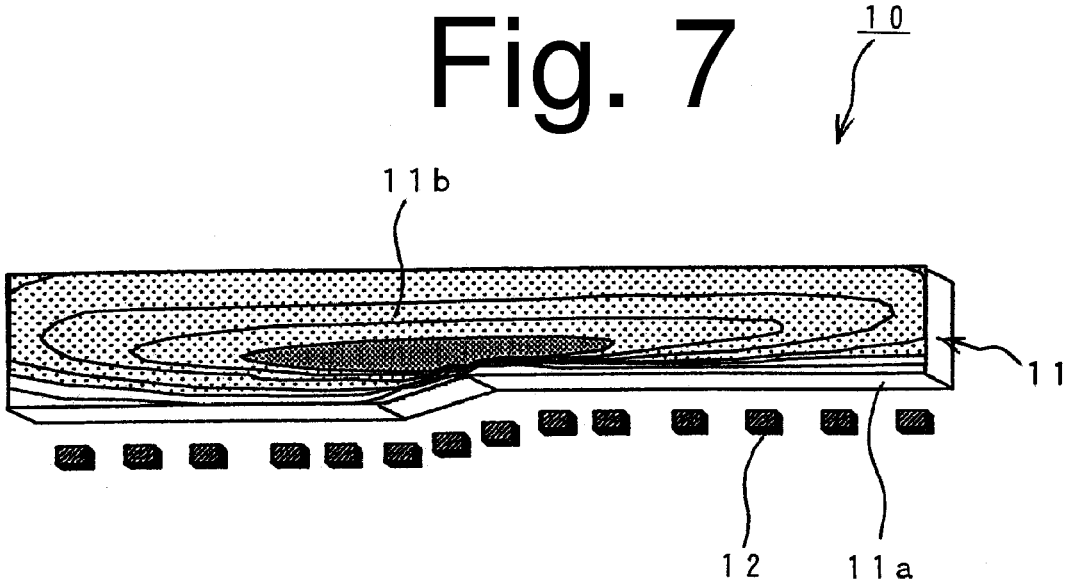
FIG. 7 is a schematic perspective view showing the entire shape of the light guide plate of the light source device of FIG. 6 when viewed from above.

The light guide plate 11 can have, as shown in FIG. 7, a light emitting surface 11*b* shaped in accordance with a desired (or required) light distribution pattern. Specifically, the surface shape is based on the desired light distribution pattern, but reduced and horizontally and vertically reversed. The light distribution pattern may be a low beam pattern with a cut-off line.

Accordingly, the light guide plate 11 in the present exemplary embodiment has a step portion at the end surface 11*a* near its center as shown in FIG. 6 or FIG. 7. Moreover, the width dimension of the guide plate 11 taken from the incident surface 11*a* to the end surface 11*c* is substantially the same along a width extending from a side surface to a certain distance from the side surface. At that certain distance, the width gradually tapers to a second width dimension and then remains substantially at that second width dimension to the other opposite side surface of the plate. Thus, a step portion is formed near a center of the end surface 11*a*.

Figure 8:
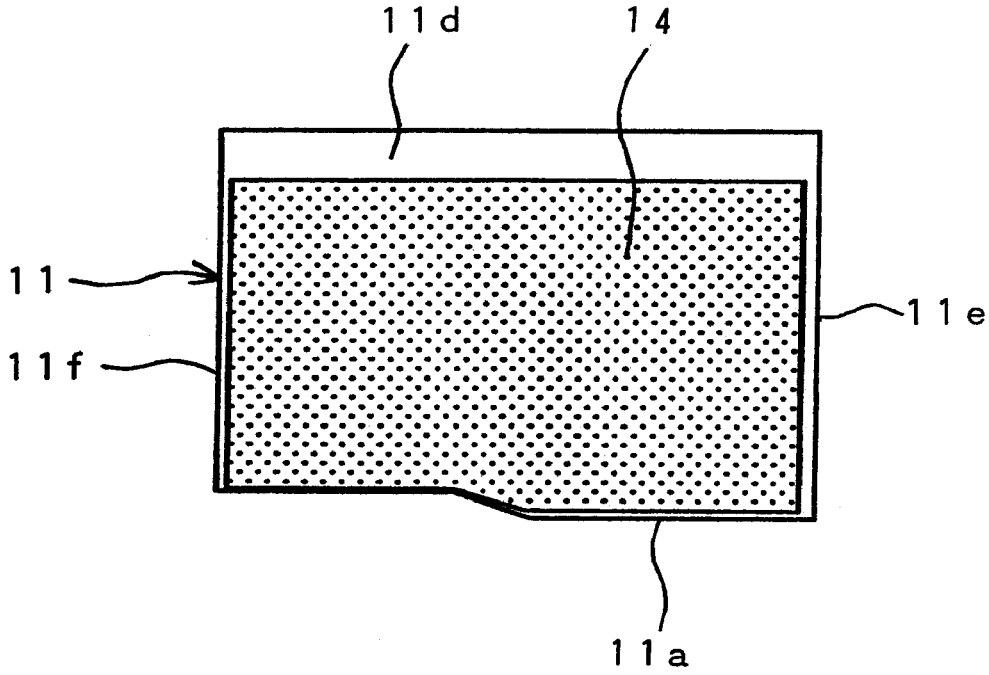
FIG. 8 is a bottom view of the light guide plate including the luminance control element of the light source device of FIG. 6.

As shown in FIG. 8, the rear surface (bottom surface) of the light guide plate 11 has a luminance control element 14 for creating the predetermined light distribution pattern.

The luminance control element 14 can be made of a fine structure of dots or grooves, or a high reflectivity ink or coating.

Part of light entering the light guide plate 11 can reach the luminance control element 14, and when the condition for total reflection does not hold, the light may exit through the light emitting surface 11*b* opposite to the luminance control element 14.

Here, based on the shapes, sizes, and distribution densities of the luminance control element 14, the light to be emitted from the light emission surface 11*b* of the light guide plate 11 is given a luminance distribution corresponding to a reduced inversion of the light distribution pattern to be emitted.

The light guide plate 11 as described above may be formed, for example, by injection molding, press molding, or extrusion molding the foregoing transparent resin material, using a metal mold having a predetermined shaped cavity. It may otherwise be manufactured by press molding glass, using a desired die, etc.

The resulting light guide plate 11 may be provided with a luminance control element by printing. Alternatively, it may be manufactured by injection molding or extrusion molding a plate-like material of transparent resin, followed by micromachining of the luminance control element.

Such a fine structure is composed of fine concave and convex dots in the shape of a dome, a rectangular frustum, a truncated cone (with a circular or elliptical bottom)), or any shaped frustum, or a combination thereof, etc.

The distance between adjacent fine dots, or the area ratio between the dot bottom area and the surrounding gap between dots, can be appropriately set to adjust the density of the luminance control element. The adjusted density can form the desired luminance distribution formed on the light emitting surface 11*b*. Namely, a high density area of the luminance control element can form a high luminance area on the light emitting surface 11*b* whereas a low density area can form a low luminance area.

Moreover, even assuming the same density of the luminance control element, the greater height (depth) that each of the fine dots has, the higher that the brightness at the corresponding position of the light emission surface 11*b* is. The smaller height (depth) that each of the fine dots has, the lower that the brightness at the corresponding position of the light emission surface 11*b* is.

The fine structure for forming the luminance control element may be a fine shape of prisms or knurl-shape in parallel to each other by extrusion molding a free curved surface with a triangle or elliptic arc cross section on the light emitting surface 11*a*.

In this case, the density of the luminance control element shall refer to the ratio of the bottom width of adjoining prisms or knurls to the distance therebetween. The higher this density is, the higher the brightness at the corresponding position of the light emission surface 11*b* is. The lower the density, the lower the brightness at the corresponding position of the light emission surface 11*b*.

Assuming the same density of luminance control element, the greater height (depth) that each prism or knurl has, the higher the brightness at the corresponding position of the light emission surface 11*b* is. The smaller the height (depth) that each prism or knurl has, the lower that the brightness at the corresponding position of the light emission surface 11*b* is.

These prisms or knurls may be either protruded from or recessed in the light guide plate 11, and can have a bottom width of 50 μm or less.

The luminance control element 14 may be formed by printing, such as screen printing or the like, a particular pattern with a high-reflectivity ink on the transparent resin plate. The printed pattern may be composed of a dotted pattern or striped pattern of circles, ellipses, or rectangles. In this case, the density of the printed pattern, or the area ratio between the printed area and the non-printed area, can adjust the luminance distribution on the light emitting surface 11*b*, and therefore, a high density of the pattern can provide a high intensity area on the light emitting surface 11*b* and a low density thereof can provide a low intensity area thereon. In this instance, the diameter of each dot or the width of each stripe may be 0.5 mm or less.

In this way, an appropriate density for the luminance control element 14 can provide a desired luminance distribution on the light emitting surface 11*b* of the light guide plate 11.

The light guide plate 11 may also have an optical sheet or sheets 15 (in the shown case, two optical sheets 15*a* and 15*b*)

on its surface in order to enhance the brightness of the light emitted from the surface or to adjust the light distribution property.

The luminance control element 14 described above, formed on the rear surface of the light guide plate 11, reflects light so that the light is emitted at angles such as 50° to 70° or so (and any angles within that range) with respect to the normal direction to the surface of the light guide plate 11. Accordingly, the optical sheet can correct the exiting direction of the emitted light on the surface of the light guide plate 11 to be normal or substantially normal to the surface 11*b* of the plate 11. For example, an optical sheet can be employed which has a triangle prism of 50 μm on the lower side thereof.

Examples of such an optical sheet 15*a* or 15*b* can include a prism sheet or a diffusion film which are used in typical surface light source devices.

The light guide plate 11 may be used with such a prism sheet, which can be obtained by imparting a prism shape on a thermoplastic transparent film (originally for use in an optical element) by press molding or extrusion molding. Alternatively, the light guide plate 11 may be used with a prism sheet obtained by imparting a prism shape on a UV curable transparent resin film (originally for use in an optical element) by the 2P method or the like.

The light guide plate 11 may be used with a diffusion film that is manufactured by depositing a sheet of resin or glass beads on an extrusion molded sheet of a thermoplastic transparent resin, where the resin has a different refractive index and is provided on one surface or both surfaces of the guide plate 11. Alternatively, the light guide plate 11 may be used with a diffusion film that is manufactured by extrusion molding a thermoplastic transparent resin mixed with a resin having a different refractive index or with glass beads into a film.

The light guide plate 11 may have a reflective film(s) 16 facing towards the end surface 11*c* opposite to the light incident surface 11*a*, opposite the rear surface 11*d*, and opposite the right and left side surfaces 11*e* and 11*f*, in order to improve the utilization efficiency of light emitted from the respective LEDs 12. In this case, the reflective film 16 may be a high-reflective member. Examples thereof can include a high reflectivity metal film obtained by depositing a metal such as aluminum, silver or the like on an extrusion molded resin member by vapor deposition method or sputtering; a resin film or plate obtained by adding a visible light diffusion/reflection agent such as titanium oxide into a resin film made of polycarbonate, for example; and a resin film or plate obtained by fine foam molding a resin using a supercritical fluid or by foam molding a resin using a chemical foam molding aid.

The housing 13 may serve as a reflective member in place of the reflective film 16, at least in part. In this case, the inside surface of the housing 13 may be directly provided with a high reflectivity metal film by vapor deposition method or sputtering, etc.

The light guide plate 11 also has a polarizing film 17 on its surface, or on the optical sheets 15 in particular.

This polarizing film 17 may be a polarizing film of reflection type, such as a multilayered mirror film (DBEF) from 3M and/or a brightness enhancing polarizing film NIPOCS from Nitto Denko Corporation. The polarizing film 17 is pasted or otherwise attached onto the optical sheets 15 which are formed on the surface of the light guide plate 11. As a result, the light emitted from the surface of the light guide plate 11 is transmitted through this polarizing film 17 and thus is converted into linearly-polarized light.

The polarizing film 17 is arranged so that the linearly-polarized light transmitted through the polarizing film 17 is p-polarized when this light source device 10 is mounted on a vehicle lighting device as will be described later. It should be noted that p-polarization (parallel polarization) refers to polarization having a plane of vibration parallel to the plane that contains the optical axis of the illumination light and the normal to the road surface. S-polarization (perpendicular polarization) refers to polarization having a plane of vibration perpendicular to the plane. In other words, the p-polarization light vibrates or oscillates in a plane that is substantially perpendicular to a plane containing the roadway on which the vehicle and mounted lighting device are traveling, and the s-polarization light vibrates or oscillates in a plane that is substantially parallel to a plane containing the roadway or travel surface.

Figure 9A:
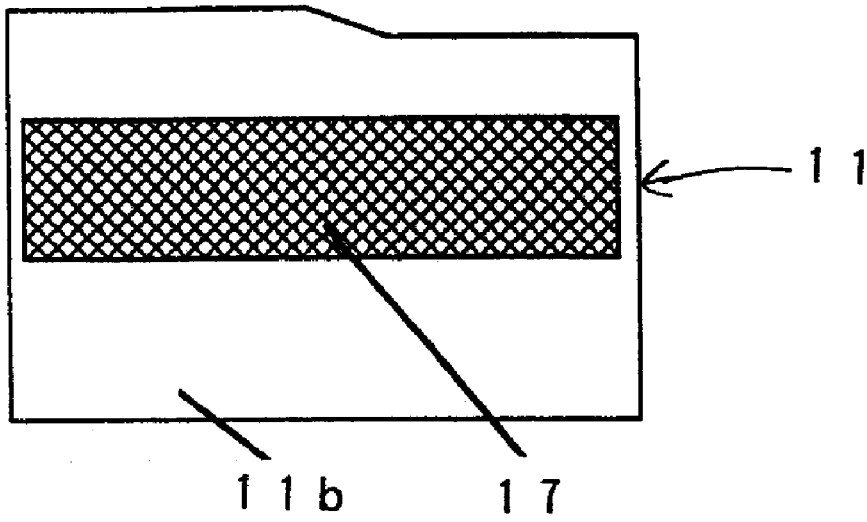
FIGS. 9A and 9B are bottom views of the light guide plate, showing a first arrangement example and a second arrangement example of a polarizing filter for the light source device of FIG. 6, respectively.

As shown in FIG. 9A, the foregoing polarizing film 17 is arranged so as to correspond to a partial area of the light distribution pattern of the luminance control element 14 described above.

This partial area is such that the angle of the optical axis of the illumination light to the road (the angle of incidence to the road) is greater than 70°, or preferably greater than 82°, when this light source device 10 is mounted on the vehicle lighting device to be described later.

Figure 9B:
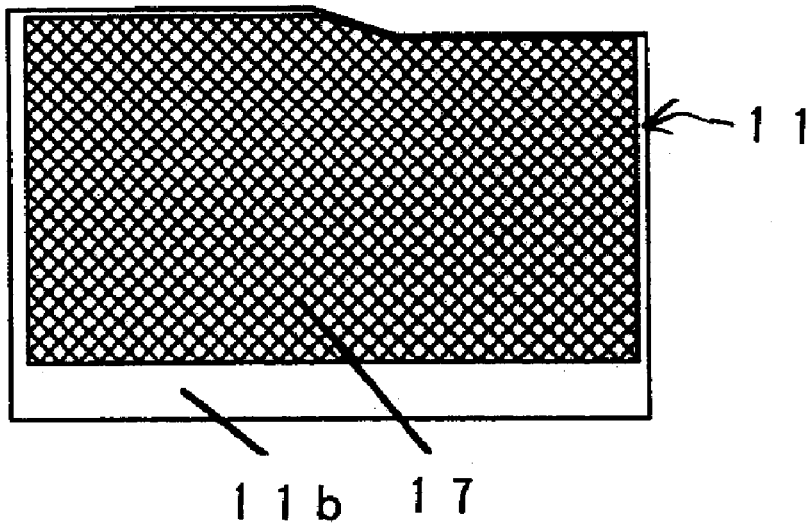

As shown in FIG. 9B, the polarizing film 17 may be arranged so as to cover the entire light distribution pattern of the luminance control element 14 described above or all over the surface of the light guide plate 11.

The LEDs 12 can be opposed to the incident surface 11*a* of the light guide plate 11 in a linear arrangement.

Here, the LEDs 12 need not be arranged at regular intervals, but are arranged at appropriate intervals along the incident surface 11*a* of the light guide plate 11 so that a predetermined luminance distribution appears on the light emission surface 11*b* of the light guide plate 11.

While the LEDs 12 are arranged in a row in the shown example, they are not limited to this arrangement but may be arranged in a plurality of rows, in a matrix, or even in particular patterns for particular applications of a light source device.

When the exemplary light source device is in use, a drive current from a not-shown external drive circuit is passed through the LEDs 12 for driving and light emission. The light emitted from the respective LEDs 12 enters the interior of the light guide plate 11 from the incident surface 11*a*. Then, the light is repeatedly, totally reflected at the surface, the rear surface, and both the lateral side surfaces of this light guide plate 11 to reach the opposite end surface, and is totally reflected by the opposite end surface to travel backward. The light is thus diffused to substantially all over the interior of the light guide plate 11.

Among the light rays that enter the light guide plate 11, part of those reaching the rear surface of the light guide plate 11 impinges on the luminance control element 14. The light is not totally reflected at these locations but is reflected upward to reach the surface of the light guide plate 11. The other part of the light impinges on the flat areas (where it is not affected) for total reflection.

As a result, the brightness of the light that reaches the surface of the light guide plate 11 is controlled by the luminance control element 14, so that the surface of the light guide plate 11 has a predetermined luminance distribution as shown in FIG. 7.

The light is further transmitted through the polarizing film 17 and is emitted upward as linearly-polarized light (p-polarized light).

As shown in FIG. 7, the light emission surface (upper surface) of the light guide plate 11 is given the shape corresponding to the cut-off pattern at the edge on the side of the incident surface 11*a*. This defines the luminance distribution corresponding to the light distribution pattern suited to the low beam of the vehicle lighting device.

Consequently, when the light emission surface 11*b* of this light guide plate 11 is projected forward in the direction of light illumination through a projection lens, it can form the light distribution pattern suited to the low beam of the vehicle.

Figure 1:
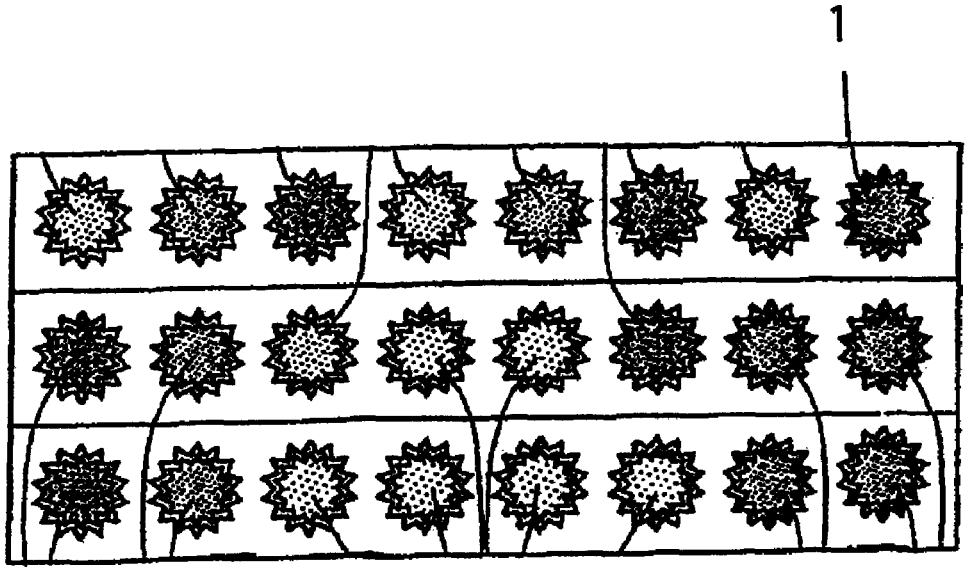
Fig. 1 Conventional Art
FIG. 1 is a plan view of a light source, showing an exemplary configuration of a conventional vehicle lighting device.
Figure 2A:
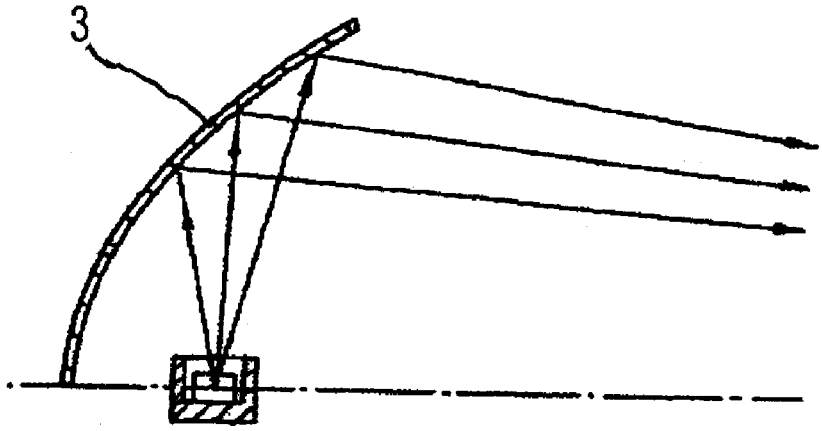
Fig. 2A Conventional Art
FIG. 2A is a cross-sectional view showing an example of the general configuration of a lighting device having a conventional LED lamp.
Figure 2B:
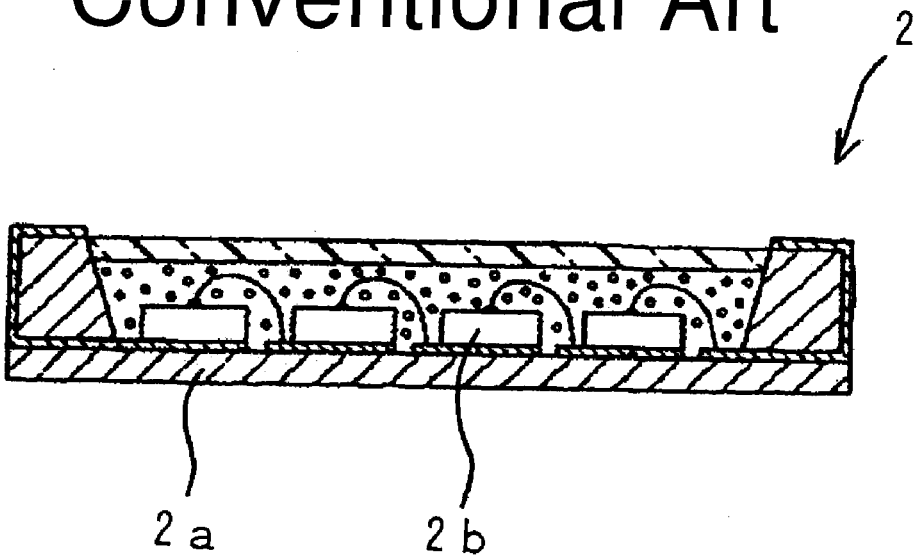
Fig. 2B Conventional Art
FIG. 2B is an enlarged sectional view of the conventional LED lamp of FIG. 2A.
Figure 3:
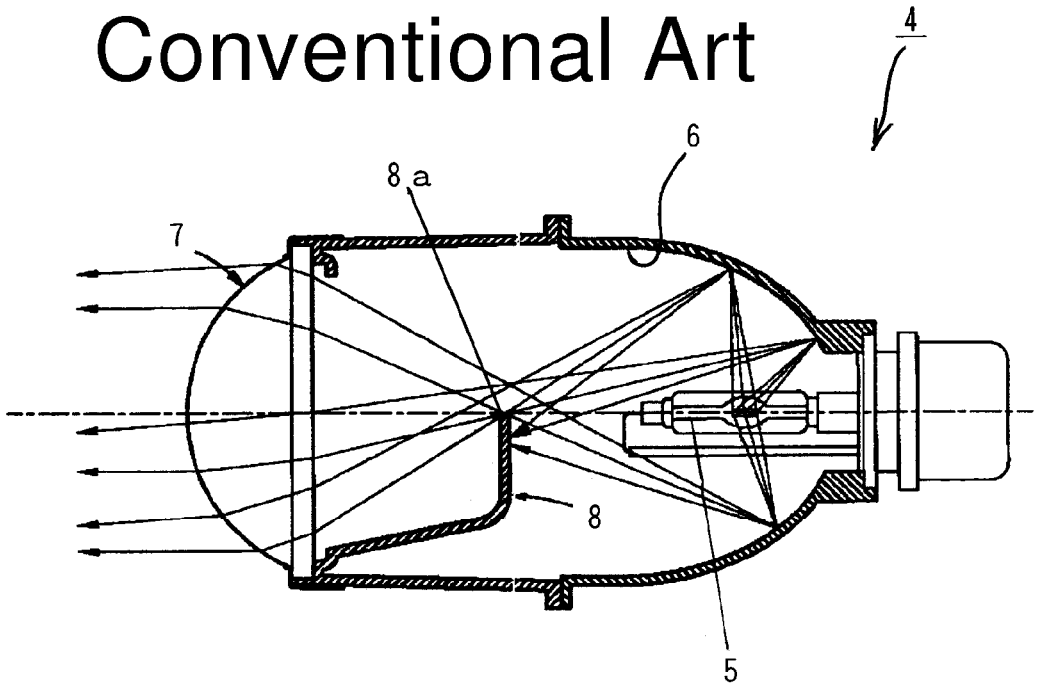
Fig. 3 Conventional Art
FIG. 3 is a schematic cross-sectional view showing an exemplary configuration of a conventional headlight.
Figure 4:
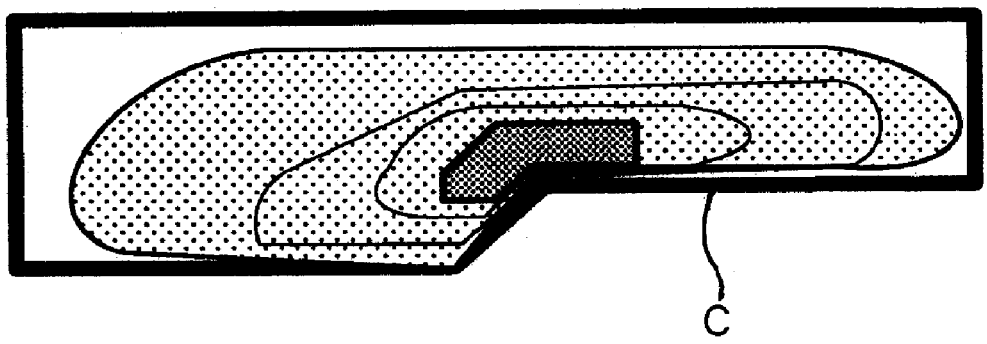
Fig. 4 Conventional Art
FIG. 4 is a schematic diagram showing a light distribution pattern of the headlight of FIG. 3.
Figure 5A:
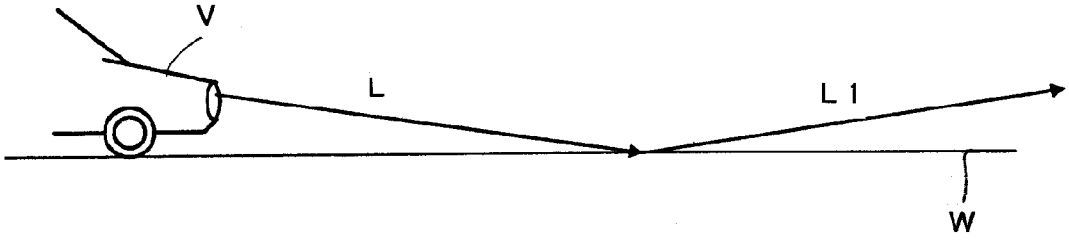
FIG. 5A is a schematic diagram showing reflection of the headlight of FIG. 3 at the water film surface.
Figure 5B:
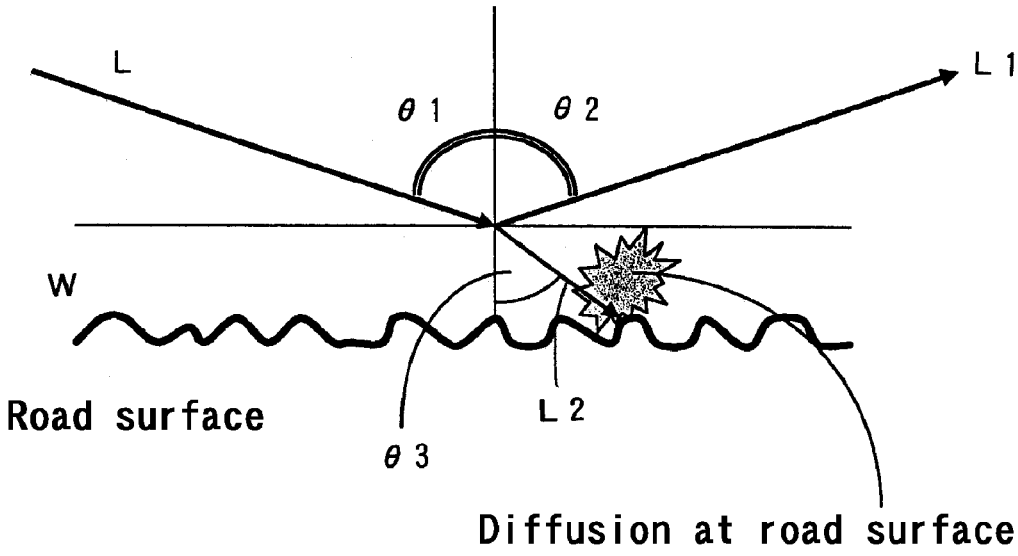
FIG. 5B is an enlarged partial sectional view showing illuminating light, reflection light, and penetrating light in the vicinity of the water film surface.

The illumination light transmitted through the polarizing film 17 is p-polarized. As a result, the reflectivity at the surface of a water film on the road decreases. This reduces the reflected light L1 at the water film surface (see FIG. 5B), i.e., glare of light to opposite traveling vehicles, pedestrians, and so on. In consequence, it becomes easier to meet regulations pertaining to glare of light.

Moreover, the light L2 which penetrates into the water film (see FIG. 5B) increases to illuminate the road surface favorably, so that the driver can visually check the road beneath the water film with reliability.

Figure 10A:
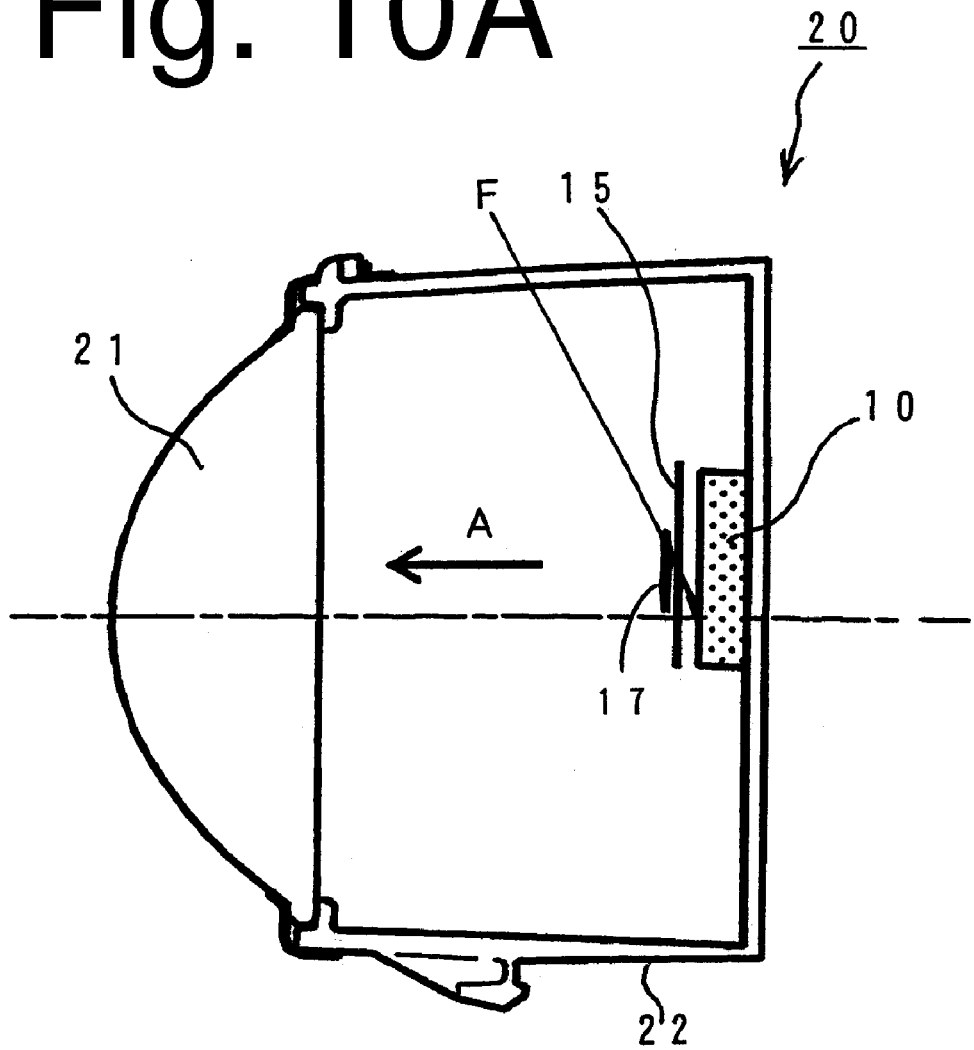
FIG. 10A is a schematic cross-sectional view showing a first configuration example of a vehicle lighting device using the light source device of FIG. 6.
Figure 10B:
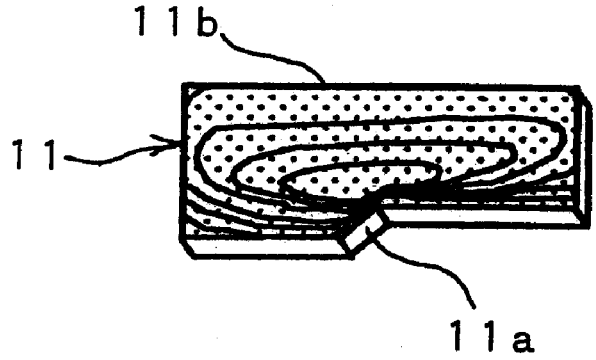
FIG. 10B is a schematic diagram showing a luminance distribution on the light emission surface of the light guide plate.

FIGS. 10A and 10B show an exemplary configuration of a vehicle lighting device that uses the light source device 10 described above.

In FIG. 10A, the vehicle lighting device 20 can include the light source device 10, accompanied with the optical sheets 15 and the polarizing film 17, and a projection lens 21 for focusing the light from the light source device 10.

The light source device 10 is arranged near the center of the rear end of a box-shaped housing 22 which is opened to the front of the vehicle lighting device 20. Here, the light source device 10 is situated so as to emit light L toward the front in the direction of light illumination (the direction of the arrow A) through the optical sheets 15 and the polarizing film 17.

The projection lens 21 is a convex lens which is arranged so that its focus F on the side of the light source device 10 lies near the center of an edge of the light guide plate 11 of the light source device 10, the edge defining the cut-off pattern on the side of the incident surface 11*a*.

In the vehicle lighting device 20 of this configuration, electricity is supplied to the LEDs 12 of the light source device 10 for light emission. This makes the light emission surface 11*b* of the light guide plate 11 emit light with a predetermined luminance distribution as shown in FIG. 10B.

The luminance distribution defined on the light emission surface 11*b* of this light guide plate 11 is projected forward in the direction of light illumination through the projection lens 21.

As a result, a magnified inversion of this luminance distribution is projected forward in the direction of light illumination, thereby forming a light distribution pattern intended for a predetermined low beam.

In this instance, the light source device 10 itself defines the desired luminance distribution on the light emission surface 11*b* of its light guide plate 11. This eliminates the need for a reflecting surface for creating the light distribution pattern or a light-shielding member for creating the cut-off line as in conventional vehicle lighting devices of projector type.

The entire vehicle lighting device 20 is thus significantly reduced in length in the front-to-rear direction, so that it can be configured with smaller size and lighter weight, without requiring a light-shielding member. The result is a smaller parts count, with a significant reduction in parts cost and assembly cost.

Since the light emission surface 11*b* of the light guide plate 11 is shaped to the cut-off pattern on the side of the incident surface 11*a*, it is easily possible to make the light emission surface 11*b* high in brightness on the side of the incident surface 11*a*. As a result, the cutoff line, or bright-dark boundary, of the light distribution pattern formed on the side of this incident surface 11*a* can be projected clearly with high brightness.

It should be noted that, suppose that the incident surface 11*a* is arranged on a side other than where the edge of the light emission surface 11*b* of the light guide plate 11 is shaped with the cut-off pattern. Even in such cases, the cut-off line, i.e., the bright-dark boundary of the distribution pattern can also be projected clearly in high brightness by designing the sectional configuration of the light guide plate 11 appropriately and adjusting the concentration distribution of the luminance control element appropriately.

The LEDs 12 are arranged at smaller intervals in the area where higher brightness is required in the light distribution pattern. This facilitates providing higher brightness in the desired light distribution pattern.

The light emitted from the light source device 10 is transmitted through the polarizing film 17 for p-polarization. This lowers the reflectivity at the surface of a water film on the road, thereby reducing the reflected light L1 at the water film surface (see FIG. 5B), i.e., glare of light to opposite traveling vehicles, pedestrians, and so on. In consequence, it becomes possible to meet government regulations pertaining to glare of light.

In addition, the light L2 which penetrates into the water film (see FIG. 5B) increases so as to illuminate the road surface favorably. Thus, that the driver can visually check the road beneath the water film with reliability.

Figure 11:
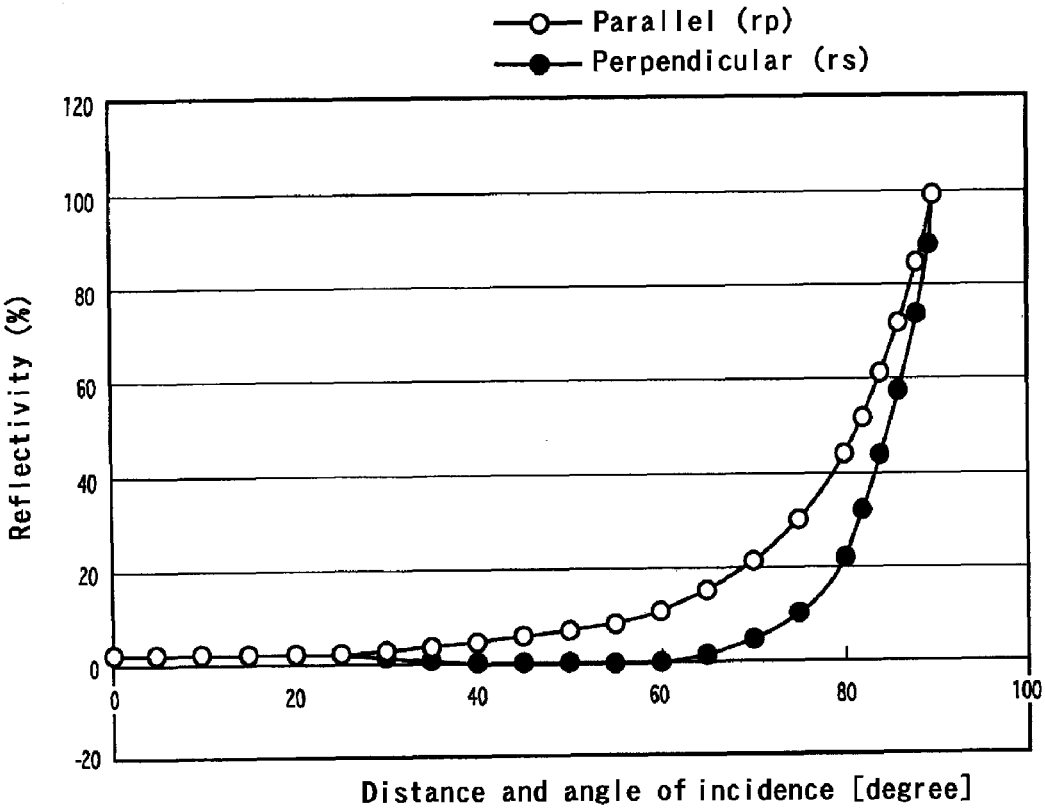
FIG. 11 is a graph showing the relationship between the angles of incidence of p- and s-polarized beams to the water film surface and the reflectivities thereof.

More specifically, the angles of incidence of p-polarized light (parallel polarized light) and s-polarized light (perpendicular polarized light) to the water film surface and the reflectivities thereof have a relationship such that the reflectivity of the p-polarized light is lower than that of the s-polarized light as shown in FIG. 11.

Besides, the reflectivity of the p-polarized light increases sharply at angles of incidence of 70° or above.

Based on the graph of FIG. 11, the reflectivities of the p-polarized light and the s-polarized light were determined with respect to the angle of incidence, and the intensities of light which penetrates into and beneath the water film (the intensity Ip of p-polarized light and the intensity Is of s-polarized light to penetrate) were determined. The calculation on the difference in intensity (Ip−Is) is traced in the graph of FIG. 12.

From the graph, it can be seen that the difference in the intensity of light which penetrates (Ip−Is) peaks around the angle of incidence of 80°.

Figure 13:
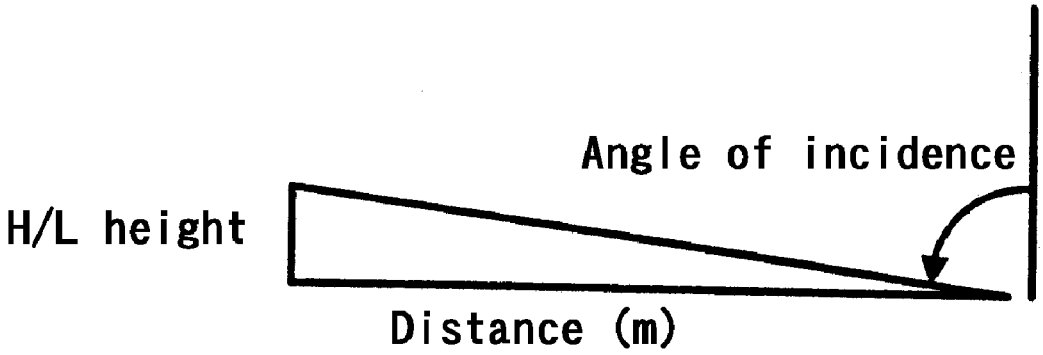
FIG. 13 is a schematic diagram showing a headlight height, distance, and the angle of incidence of the vehicle lighting device.
Figure 14:
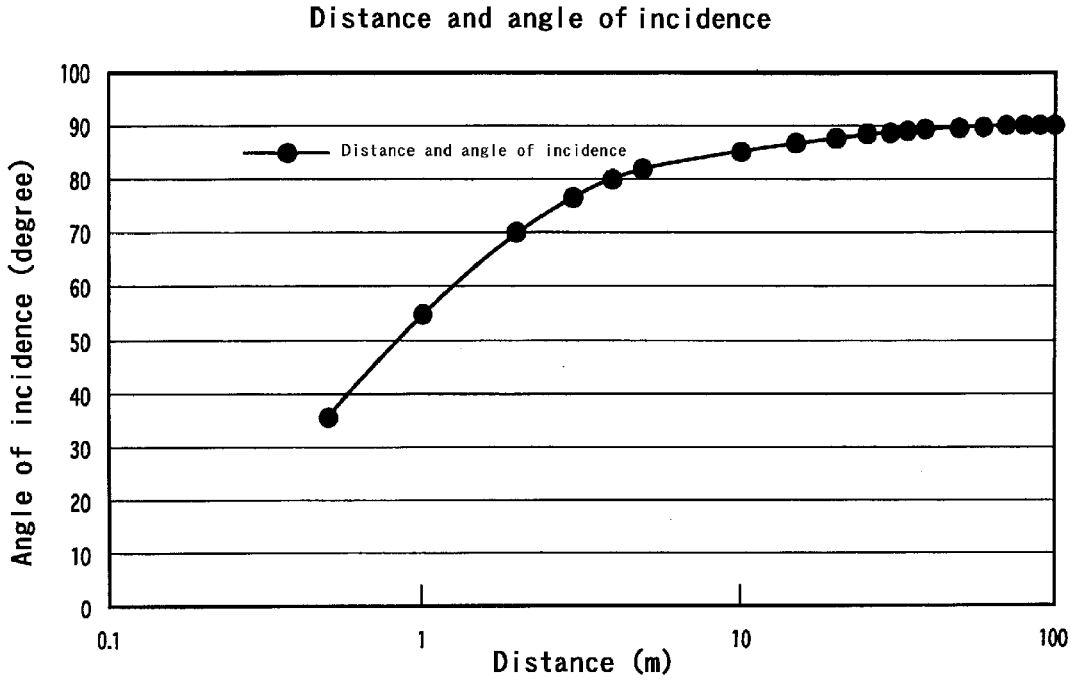
FIG. 14 is a graph showing the relationship between the distance and the angle of incidence for the case of a headlight height of 0.7 m.

Now, as shown in FIG. 13, the angle of incidence of the vehicle lighting device to the road surface depends on both the headlight height from the road to the center of the vehicle lighting device and the distance to the illumination position. Assuming that the headlight height is 0.7 m, the foregoing relationship between the distance and the angle of incidence is shown in FIG. 14. From FIG. 14, it can be seen that the angle of incidence to the road reaches or exceeds 80° at distances of 4 m and above.

Figure 12:
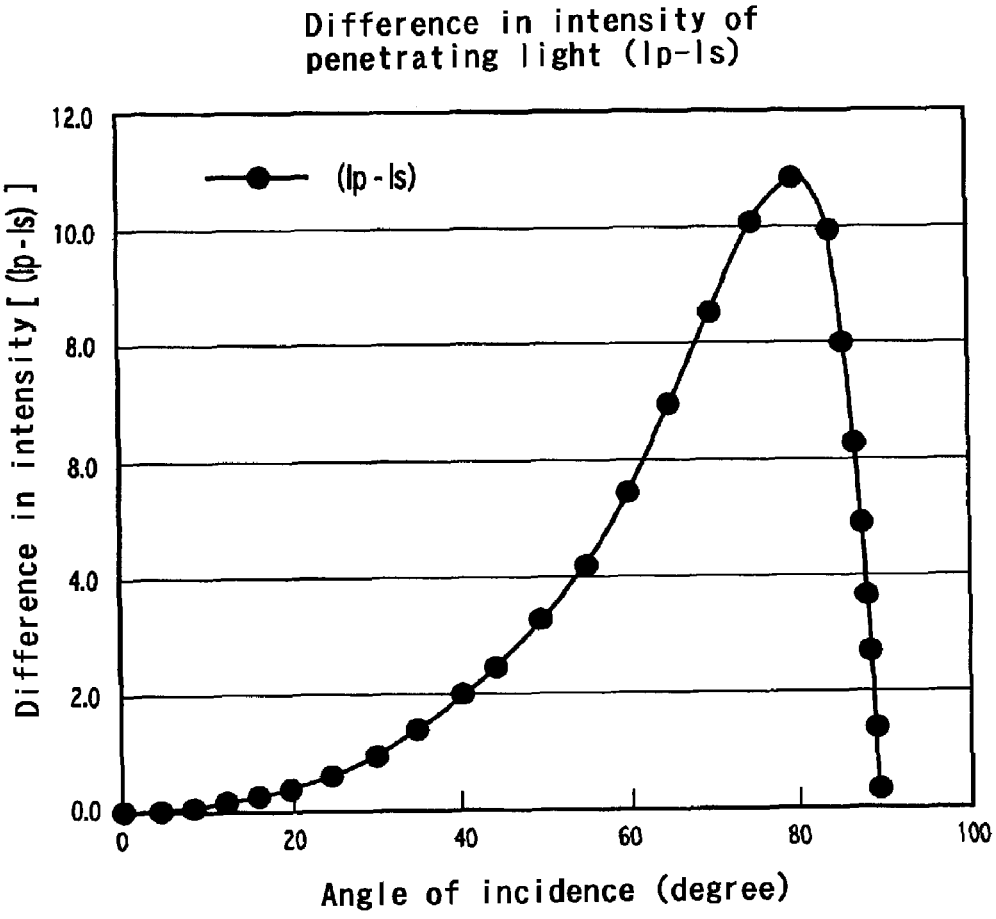
FIG. 12 is a graph showing the relationship between the angles of incidence of p- and s-polarized beams to the water film surface and the difference in intensity of penetrating light thereof.

Meanwhile, in FIG. 12, the difference in the intensity of light which penetrates into and beneath the water film (Ip−Is) shows high values for angles of incidence of 60° to 88°.

Taking account of such factors as the distance for the driver on the moving vehicle to acquire information for determining the road condition, it is shown that the driver can grasp the road condition more easily if the range of 2 m to 40 m in distance in front of the vehicle (70° to 89° in the angle of incidence), or the range of 5 m to 20 m in distance in front of the vehicle (82° to 88° in the angle of incidence) is illuminated with p-polarized light.

This distance range can be illuminated with p-polarized light if the foregoing polarizing film 17 is arranged on the surface of the light guide plate 11, for example, at least over the area that is equivalent to a light distribution pattern corresponding to those distance ranges as shown in FIGS. 6 and 9A.

This can effectively reduce the reflection of the illumination light from the surface of a water film, if any, and reduce glare of light as well. In addition, since the proportion of the illumination light which penetrates into the water film increases, the driver can visually check the road surface beneath the water film with higher reliability.

Consequently, at the measuring points for glare control according to certain light distribution regulations, such as ECE and FMVSS mentioned above, the reflection from the water film surface, i.e., glare of light, can be reduced to easily meet these regulations.

Second Exemplary Embodiment

Figure 15:
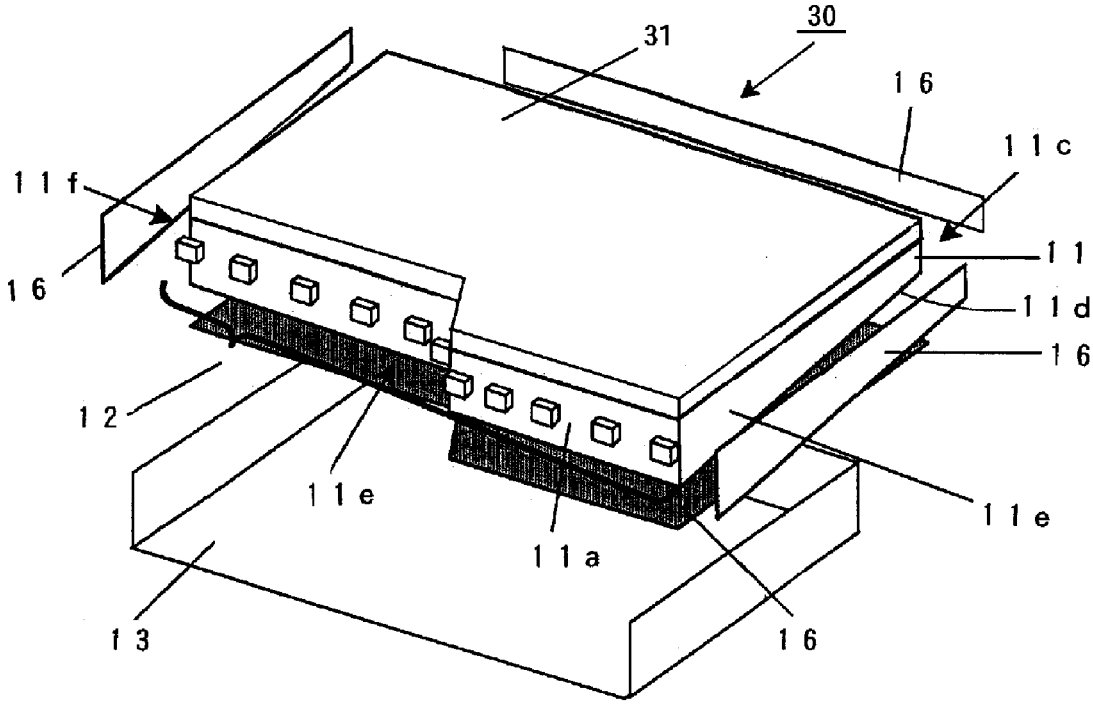
FIG. 15 is a partial schematic diagram showing the configuration of a second exemplary embodiment of a light source device made in accordance with principles of the presently disclosed subject matter.

FIG. 15 shows a perspective view of a second exemplary embodiment of a light source device for a vehicle lighting device made in accordance with principles of the presently disclosed subject matter.

In FIG. 15, the light source device 30 can have almost the same configuration as that of the light source device 10 shown in FIGS. 6 to 8. The same components will thus be designated with like reference numerals, and a description thereof will be omitted.

As compared to the light source device 10 shown in FIG. 6, the light source device 30 differs in that a stretched polymer film 31 is arranged inside or on the light guide plate 11 instead of the polarizing film 17.

This stretched polymer film 31 is formed, for example, as shown in FIGS. 16A to 16D.

Figure 16A:
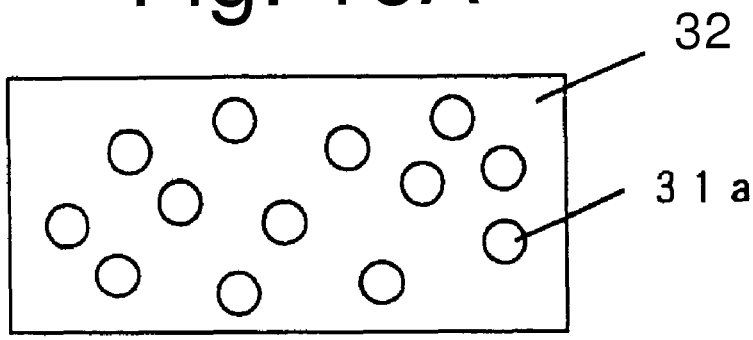
FIGS. 16A to 16D are schematic diagrams showing a method of forming a stretched polymer film for the light source device of FIG. 10A, and a modification thereof.
Figure 16B:
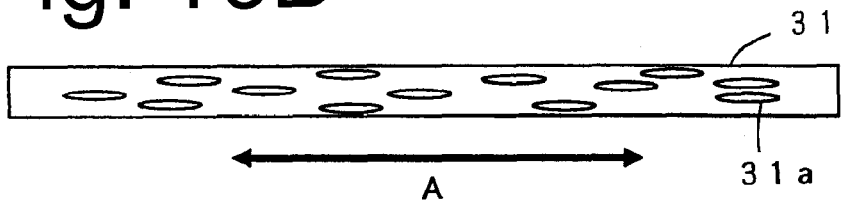

A PET film 32 having core shells inside, shown in FIG. 16A, is initially stretched in the direction of the arrow A in FIG. 16B, thereby forming elliptical areas 31*a* (voids) of high ellipticity which are stretched in this direction A.

Figure 16C:
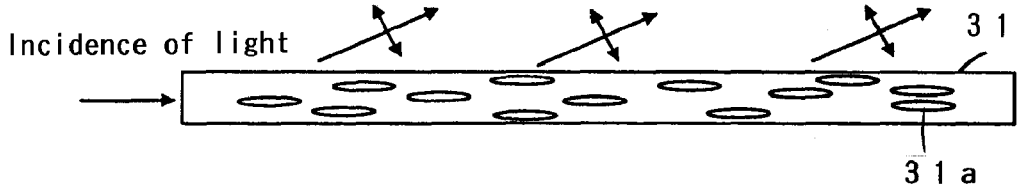

The resulting stretched polymer film 31 is configured so that when the light from the light source enters the voids 31*a* of the stretched polymer film 31 as shown in FIG. 16C, p-polarized components alone are reflected and emitted, for example, from the top.

The stretched polymer film 31 having this polarization selective diffusibility can be formed, for example, by using a 360-μm-thick PET film which contains 5% of core shells in the film 32.

Note that, as shown in FIG. 16C, the direction of light emission from the stretched polymer film 31 is not in the normal direction but slightly tilted away from the light source.

Figure 16D:
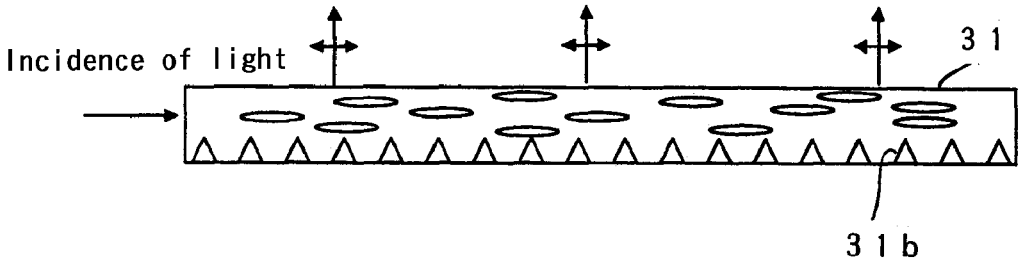

Here, in order to align the direction of light emission with the normal direction, grooves 31*b* may be formed in the side of the stretched polymer film 31 opposite from the light emission surface as shown in FIG. 16D.

For example, these grooves 31*b* can have a depth of around 50 μm, with an isosceles triangular section having a vertex angle of 50° or so. The grooves 31*b* are arranged at pitches of around 100 to 200 μm in the foregoing direction A.

Alternatively, these grooves 31*b* may be replaced with linear protrusions having an asymmetrically-shaped section that is upright on the light-source side and tilted on the other side. For example, these protrusions can have a height of around 10 μm with a right triangular section, and are also arranged at pitches of around 100 to 200 μm in the foregoing direction A.

Then, the light incident on these grooves 31*b* (or protrusions) is totally reflected by the surfaces of the grooves 31*b* (or protrusion) and is guided into the normal direction for upward emission as shown in FIG. 16D.

As shown in FIG. 15, the stretched polymer film 31 may be formed over the surface of the light guide plate 11, in an appropriate position inside the light guide plate 11, or on the incident surface 11*a*.

Consequently, the light from the LEDs 12 enters the light guide plate 11, and is emitted from the light emission surface 11*b* of the light guide plate 11 as p-polarized light.

The light source device 30 having such a configuration can provide the same operation as that of the light source device 10 shown in FIGS. 6 to 8. More specifically, the brightness of the light emitted from the surface of the light guide plate 11 is controlled by the luminance control element 14, so that the surface of the light guide plate 11 has a predetermined luminance distribution.

The light is transmitted through the stretched polymer film 31 and emitted upward as linearly-polarized light (p-polarized light).

Now, the foregoing exemplary embodiments have dealt only with the cases where the vehicle lighting device has a light distribution property intended for a low beam of a left-side traffic vehicle. That is, the cut-off pattern has been configured not to project light to above the horizontal level on the right side of the vehicle as viewed going forward, so as not to cast dazzling light to opposite traveling vehicles. This is not restrictive, however. For right-side traffic vehicles, the vehicle lighting devices can also provide the same effects if their cut-off pattern is inverted horizontally.

The foregoing exemplary embodiments have dealt with the cases where the polarizing film in use is of a reflection type. This is not restrictive, however. Any optical film may be used as long as it has substantially equivalent functionality with respect to the optical films described above.

In the foregoing exemplary embodiments, the polarizing film is fixed to the surface of the light guide plate 11 by such means as pasting. This is not restrictive, however, and the polarizing film may be retractably arranged opposite to the surface of the light guide plate 11, and can be attached via other structures or chemicals or processes, etc.

For example, based on a detection signal of a raindrop sensor, the polarizing film can be moved into a position opposite to the surface of the light guide plate so that the foregoing reflection light at the water film surface decreases and the amount of light which penetrates into the water film increases. The polarizing film can also be retracted so that the light emitted from the light guide plate is projected directly without the intervention of the polarizing film. This can further enhance the brightness of the light distribution pattern during various conditions.

The foregoing exemplary embodiments have also dealt with the cases where a plurality of point-source LEDs 12 are arranged and used along one side of the light guide plate 11. This is not restrictive, however, and other types of point light sources such as semiconductor laser devices may also be used. Line sources may also be used, and the incident surface may also be disposed at a plurality of end surfaces of the light guide plate 11 as long as the light guide plate 11 can internally define the predetermined luminance distribution on the light emission surface 11*b* by means of the luminance control element 14.

The light source device made in accordance with principles of the presently disclosed subject matter is not only applicable to a light source for a vehicle lighting device, but is also applicable to other lighting applications, especially when it is desired to illuminate substances and the like under a water film with high efficiency. This finds such applications as in light sources for outdoor lighting. Since the cut-off line may not be necessary in applications outside the vehicle lighting device area, the light guide plate 11 may be formed in an arbitrary shape depending on the application.

A light source device made in accordance with principles of the presently disclosed subject matter can also effectively illuminate substances and the like lying under a film that has a refractive index different from that of air, not necessarily a water film.

Consequently, examples of applications of a light source device made in accordance with the principle of the presently disclosed subject matter include a light source for a vehicle lighting device of a two- or four-wheel vehicle, an illumination light source to be combined with image recognition or image processing, an illumination light source for illuminating underwater from outside, and outdoor lighting.

In particular, in the case of an illumination light source for illuminating underwater, the increased amount of light to penetrate into the water improves the illumination efficiency.

For outdoor lighting, the reflection of the light at wet surfaces in the rain can be reduced for improved visibility, making display of ads and the like easier to view.

As has been described, according to the presently disclosed subject matter, it is possible to provide an LED light source device having a simple configuration and which can create a desired light distribution pattern easily with a low profile and light weight, and an illumination apparatus and a vehicle lighting device using this LED light source device.

It will be apparent to those skilled in the art that various modifications and variations can be made in the present invention without departing from the spirit or scope of the invention. Thus, it is intended that the present disclosure cover the modifications and variations of this invention provided they come within the scope of the appended claims and their equivalents. All related and conventional art references described above are hereby incorporated in their entirety by reference.

What is claimed is:

1. A light source device configured to emit light along an optical axis comprising:

a light guide member having a flat plate-like shape and made of a material transparent in a visible range, the light guide member having a front surface serving as a light emission surface and a rear surface opposed to the front surface and having a luminance control element configured to control a luminance distribution on the light emission surface, the front surface and rear surface separated by at least one end surface; and a light source including at least one of a point light source and a linear light source facing the at least one end surface of the light guide member, wherein the luminance control element is configured to control light reaching the luminance control element from the at least one end surface of the light guide member and to configure the light into the luminance distribution of light on the light emission surface, the luminance distribution configured to form a light distribution pattern to be projected, the light guide member is configured to emit, from the light emission surface, only parallel polarized light out of the total light emitted from the light source, the parallel polarized light being p-polarized with a plane of vibration parallel to a plane that contains the optical axis and is normal to a surface that is to be illuminated, wherein the light guide member is provided with a stretched polymer film thereinside or thereon, the stretched polymer film having elliptically-shaped small areas of different refractive index so as to show selective polarization and diffusibility.

2. The light source device according to claim 1, wherein the light guide member has a polarizing film formed on at least part of the light emission surface.

3. The light source device according to claim 2, wherein the polarizing film covers at least part of an area configured to form the light distribution pattern on the light emission surface of the light guide member.

4. The light source device according to claim 1, wherein the stretched polymer film has a plurality of side surfaces, and at least one of the side surfaces of the stretched polymer film has pits and projections configured to emit light in a direction normal to the stretched polymer film, the pits and projections formed at a predetermined pitch.

5. The light source device according to claim 2, wherein the polarizing film is retractably attached and moveable with respect to an optical path extending from the light source through the light guide member and to an area exterior of the light source device.

6. The light source device according to claim 3, wherein the polarizing film is retractably attached and moveable with respect to an optical path extending from the light source through the light guide member and to an area exterior of the light source device.

7. The light source device according to claim 1, wherein the stretched polymer film is retractably attached and moveable with respect to an optical path extending from the light source through the light guide member and to an area exterior of the light source device.

8. The light source device according to claim 4, wherein the stretched polymer film is retractably attached and moveable with respect to an optical path extending from the light source through the light guide member and to an area exterior of the light source device.

9. A vehicle lighting device comprising:

the light source device according to claim 1; and a convex projection lens configured to project light emitted from the light source device along an optical axis of the lens and forward in a direction of light illumination, the projection lens having a focus on a side of the lens adjacent the light source device and located substantially at the light emission surface of the light guide member of the light source device.

10. The vehicle lighting device according to claim 9, wherein the light guide member has a polarizing film formed on at least part of the light emission surface.

11. The vehicle lighting device according to claim 10, wherein the polarizing film covers at least part of an area configured to form the light distribution pattern on the light emission surface of the light guide member.

12. The vehicle lighting device according to claim 9, wherein the light guide member is provided with a stretched polymer film thereinside or thereon, the stretched polymer film having elliptically-shaped small areas of different refractive index so as to show selective polarization and diffusibility.

13. The vehicle lighting device according to claim 12, wherein the stretched polymer film has a plurality of side surfaces, and at least one of the side surfaces of the stretched polymer film has pits and projections configured to emit light in a direction normal to the stretched polymer film, the pits and projections formed at a predetermined pitch.

14. The vehicle lighting device according to claim 10, wherein the polarizing film is retractably attached and moveable with respect to an optical path extending from the light source through the light guide member and to an area exterior of the light source device.

15. The vehicle lighting device according to claim 11, wherein the polarizing film is retractably attached and moveable with respect to an optical path extending from the light source through the light guide member and to an area exterior of the light source device.

16. The vehicle lighting device according to claim 12, wherein the stretched polymer film is retractably attached and moveable with respect to an optical path extending from the light source through the light guide member and to an area exterior of the light source device.

17. The vehicle lighting device according to claim 12, wherein the vehicle lighting device is configured for attachment to a vehicle, the plane of vibration for the p-polarized light is substantially perpendicular to a roadway upon which the vehicle travels when the vehicle lighting device is attached to the vehicle.

18. The vehicle lighting device according to claim 1, wherein the luminescence control element includes a control element structure comprised of at least one of dots and grooves.

19. The vehicle lighting device according to claim 18, wherein the control element structure is comprised of ink.

20. A light source device configured to emit light along an optical axis comprising:

a light guide member made of a material transparent in a visible range, the light guide member having a front light emission surface and a rear surface opposed to the front light emission surface, the front light emission surface and rear surface being separated by at least one end surface;

a luminance control element located adjacent a surface of the light guide member and configured to control a luminance distribution of light on the front light emission surface, the luminescence control element including at least one of a plurality of indent structures located in the light guide member and a plurality of three-dimensional structures located adjacent a surface of the light guide member; and a light source including at least one of a point light source and a linear light source located adjacent and facing the at least one end surface of the light guide member; and a polarizing structure located adjacent the light guide member and configured to cause light emitted from the light emission surface to be polarized, wherein the polarizing structure is a stretched polymer film, the stretched polymer film having elliptically-shaped small areas of different refractive index.

21. The light source device according to claim 20, wherein the luminescence control element includes the plurality of three-dimensional structures located adjacent the surface of the light guide member comprised of at least one of dots and grooves formed by an ink pattern.

22. The light source device according to claim 20, wherein the luminescence control element includes the plurality of three-dimensional indent structures.

23. The light source device according to claim 20, wherein the stretched polymer film has a plurality of side surfaces, and at least one of the side surfaces of the stretched polymer film has pits and projections configured to emit light in a direction normal to a largest planar surface area of the stretched polymer film, the pits and projections formed at a predetermined pitch.

24. The light source device according to claim 20, wherein the polarizing structure is a polarizing film configured to polarize light emitted from the light source into parallel p-polarized light with a plane of vibration parallel to a plane that contains the optical axis and is normal to a surface that is to be illuminated.

25. The light source device according to claim 20, wherein the polarizing structure is retractably attached and moveable with respect to the light guide member.

26. The light source device according to claim 1, wherein the luminescence control element includes a control element structure comprised of indents machined into a surface of the light guide member.

27. A light source device configured to emit light along an optical axis comprising:

a light guide member having a flat plate-like shape and made of a material transparent in a visible range, the light guide member having a front surface serving as a light emission surface and a rear surface opposed to the front surface and having a luminance control element configured to control a luminance distribution on the light emission surface, the front surface and rear surface separated by at least one end surface;

a light source including at least one of a point light source and a linear light source facing the at least one end surface of the light guide member, wherein the luminance control element is configured to control light reaching the luminance control element from the at least one end surface of the light guide member and to configure the light into the luminance distribution of light on the light emission surface, the luminance distribution configured to form a light distribution pattern to be projected, the light guide member is configured to emit, from the light emission surface, only parallel polarized light out of the total light emitted from the light source, the parallel polarized light being p-polarized with a plane of vibration parallel to a plane that contains the optical axis and is normal to a surface that is to be illuminated; and a convex projection lens configured to project light emitted from the light source device along an optical axis of the lens and forward in a direction of light illumination, the projection lens having a focus on a side of the lens adjacent the light source device and located substantially at the light emission surface of the light guide member of the light source device.

* * * * *